United States Patent [19]

Wu

[11] 4,418,707

[45] Dec. 6, 1983

[54] LOCKING DEVICE OF AN AUTOMATIC OPENING UMBRELLA

[76] Inventor: Tsun Z. Wu, No. 15, Lane 52, Ho-Ping West Rd., Section 3, Taipei, Taiwan

[21] Appl. No.: 345,587

[22] Filed: Feb. 4, 1982

[51] Int. Cl.[3] ..... A45B 25/14

[52] U.S. Cl. ..... 135/24

[58] Field of Search ..... 135/20, 22, 24

[56] References Cited

U.S. PATENT DOCUMENTS 3,906,970 9/1975 Saito ..... 135/22

*Primary Examiner*—Harland S. Skogquist

*Attorney, Agent, or Firm*—Murray Schaffer

[57] ABSTRACT

A locking device for an automatic opening umbrella having the function of an anti-missrelease and automatic locking device wherein a push button and a button seat are formed in conjunction with a spring element, whereby, by just pushing forward and depressing said button to unlock the locking device and thus continuously complete the action of automatically opening the umbrella. The push botton will automatically return to its original position in a locking up condition after the force against the button is released.

8 Claims, 9 Drawing Figures

FIG. 5A
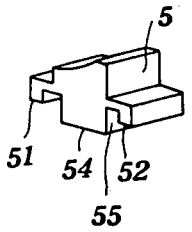
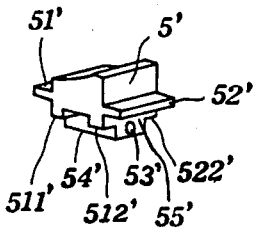
FIG. 5B
FIG. 6A
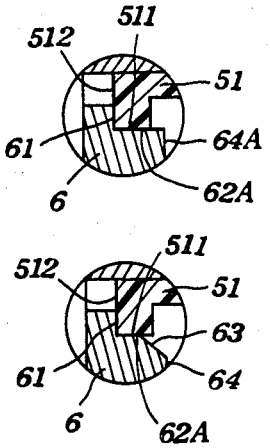
FIG. 6B
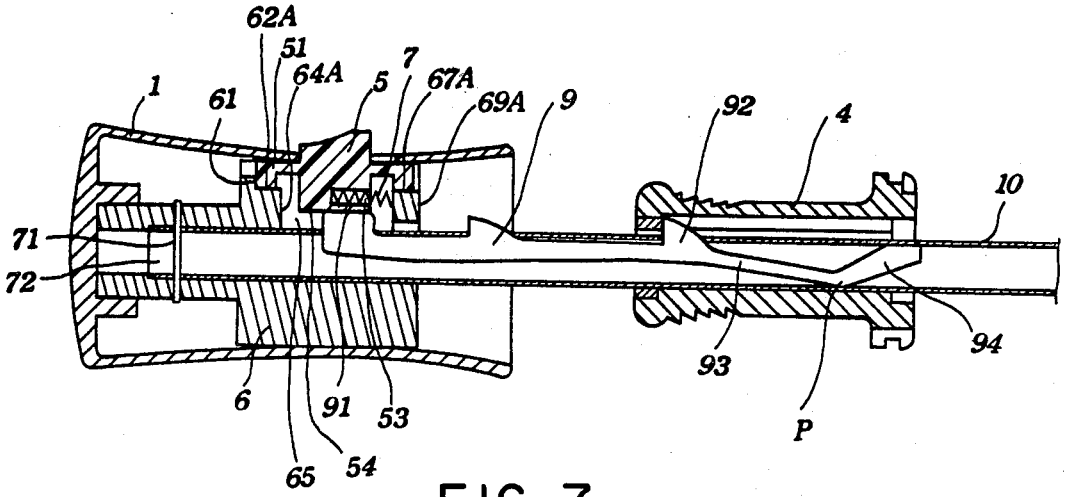
FIG. 7

LOCKING DEVICE OF AN AUTOMATIC OPENING UMBRELLA

FIELD AND BACKGROUND OF THE INVENTION

The presented invention relates generally to a locking device for an umbrella, and particularly to an anti-missrelease and automatic locking safety device for an automatic opening umbrella which, in addition to obviating embarassing events such as touching another person's body or damaging articles by the umbrella due to its improper or unexpected opening, the safe locking condition is automatically achieved whenever the actuation force on the operating button is released, while just supplying a slight force against the button in forward and downward directions, the unlocking of the locking device according to the presented invention will be achieved.

The structure of a conventional automatic opening umbrella (hereinafter referred to as the automatic umbrella) is shown in FIG. 1. If it is desired to make it open automatically, a button 2 is depressed along the direction perpendicular to the handle 1 (i.e. the direction shown by the arrow A in the drawing), thus making the retaining plate spring 3 pivotally installed about point 33 rotate slightly clockwise. This leads the retaining claw 32 at the forward end of the retaining plate spring 3 to disengage from a coupling with a lower notch cylinder 4. The lower notch cylinder 4 is then moved to the right as shown in this figure by through its correction with the originally built-in frame structure (not shown in the drawing) to attain the function of automatically opening the umbrella.

Since this kind of conventional automatic umbrella can be automatically opened by a slight downward push along the direction of arrow A even after the umbrella is closed and packed, this may occur when the user is riding on a bus or is at any public place crowded with people, or if the push button is unexpectedly pushed by the user himself or by others the umbrella will automatically open and thus the partly opened umbrella will certainly touch a nearby person. Although this may not hurt the person is touches, it is still imaginable this will give rise to some embarrassing, and unhappy circumstances especially during rainy days when the cloth of the umbrella is wet.

To prevent the above misadventure, many kinds of lock devices have been provided, wherein after the umbrella is packed up, an additional operation must be made to engage a lock device against the push button 2 or the retaining plate spring 3. When it is desired to open the umbrella, a further operation is needed to unlock the lock device, and thereafter depress the push button to make the umbrella automatically open. Evidently, this is quite troublesome in opening or packing up the umbrella, thus completely losing the simple and convenient merit of an automatic umbrella.

SUMMARY OF THE INVENTION

Accordingly, the primary object of the presented invention is the provision of a locking device for an automatic opening umbrella wherein the push button must be actuated in both a forward and downward direction to unlock the locking device.

A further object is to provide a novel arrangement of the locking device so that the push button is automatically returned to its locked condition once the actuating force on such button is released or alternatively no force is applied to the button.

Other features, additional objects, and advantages of the invention will become apparent from the accompanying drawings, the detailed description and the appended claims.

BRIEF DESCRIPTION OF THE DRAWINGS

In the drawings:

FIGS. 5A and 5B are perspective views respectively of two embodiments of a push button of the locking device, FIGS. 6A and 6B are cross-sectional views respectively of the embodiments of the guide planes of the button seat, and, FIG. 7 is a view similar to FIG. 2 showing another arrangement of the locking device according to the invention.

DETAILED DESCRIPTION OF THE INVENTION

Figure 1:
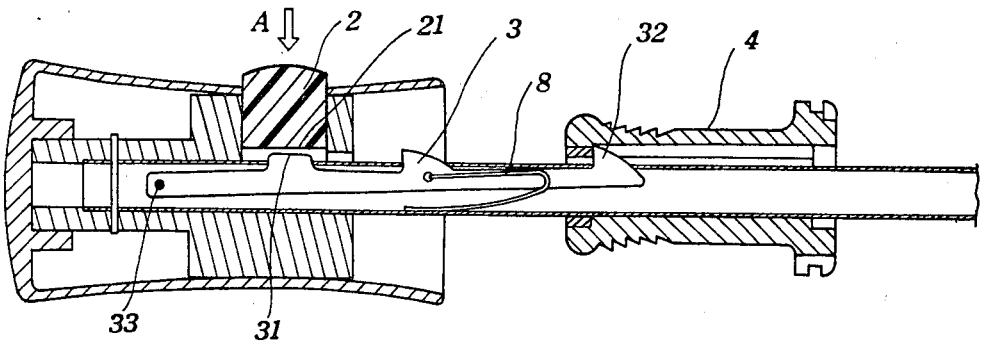
FIG. 1 PRIOR ART
FIG. 1 is a transverse sectional view of a traditional locking device of an automatic umbrella as described hereinbefore.
Figure 2:
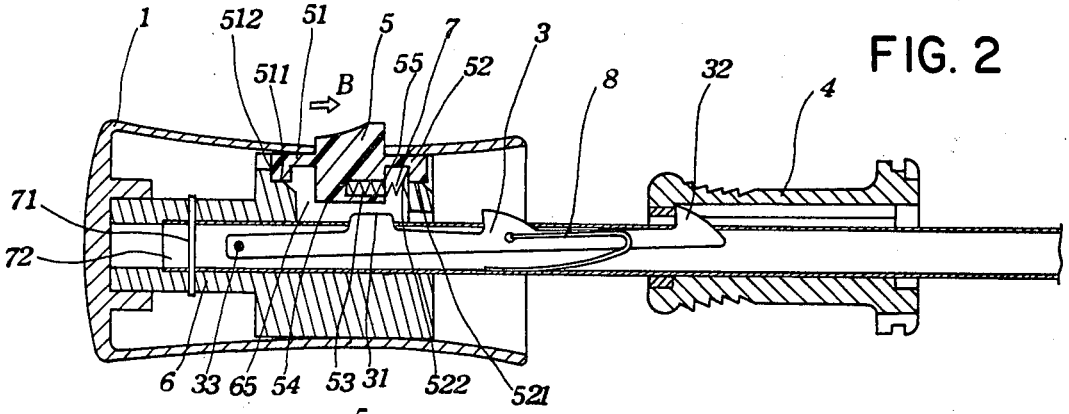
FIG. 2 is a transverse sectional view of the locking device of an automatic umbrella according to the present invention, in which the device is shown in locked condition.
Figure 3:
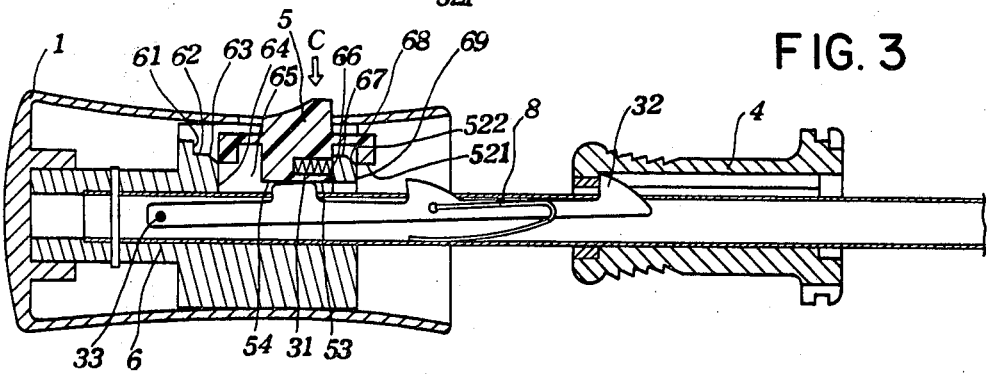
FIG. 3 is a view similar to FIG. 2 showing the locking device of an umbrella according to the invention partially opened and operation of the locking device.
Figure 4:
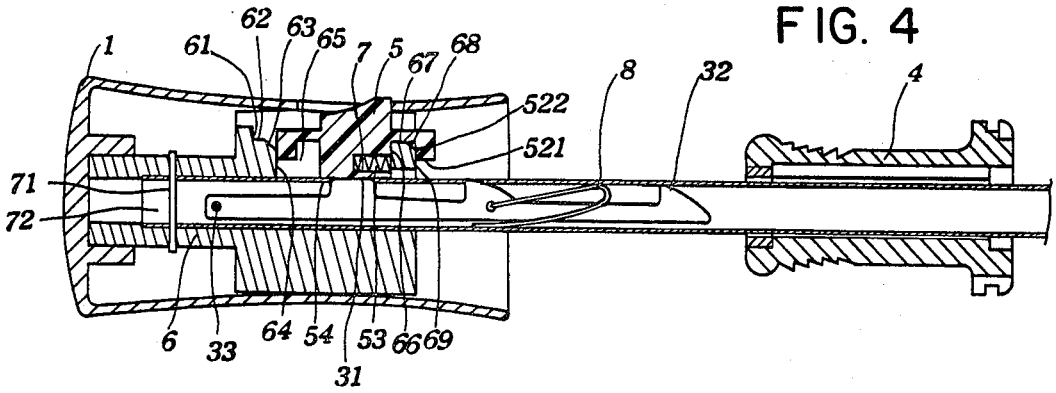
FIG. 4 is a view similar to FIG. 2 of the locking device of a fully opened automatic umbrella according to the invention.

As shown in FIGS. 2, 3 and 4, an embodiment of the anti-missrelease and safety locking device in accordance with the presented invention comprises a push button 5 is provided with two L-like arms 51 and 52 on both its axial sides. A slot 53 is formed on the bottom of the button 5 to accommodate part of a compression spring 7, the outer end of which extends and is fixed to an inner lateral surface 66 of a button seat 6. This button seat 6, just like the conventional ones, is fitted in an umbrella handle 1 and is fixed with the umbrella tube 72 by a pin 71. One side of the button seat 6 has a space 65 to receive the push button 5.

The button seat 6 is housed within the umbrella handle 1 and is defined by two vertical planes 61 and 66, two horizontal planes 62 and 67 and two oblique planes 63 and 68. In normal condition, the first arm 51 of the button 5 is stopped on the first vertical plane 61 of the button seat 6 while the bottom surfaces 511 and 521 of the first and second arms 51 and 52 are respectively in contact with the two horizontal planes 62 and 67 as shown in FIG. 2.

The operation of the anti-missrelease and safety locking device of the umbrella according to the present invention is as follows: After the umbrella is packed up, it remains in a status as shown in FIG. 2. If it is desired to open the umbrella, the user firstly applies a force on the button 5 (i.e. by use of a finger such as the thumb), forward in a direction as shown by the arrow B moving the push button 5 against the tension of the tension spring 7. At this moment, bottom surfaces 511 and 521 of the two arms 51 and 52 of the button 5 move along the two horizontal planes, 62 and 67 and the two oblique planes, 63 and 68. When the front lateral surface 55 of the button 5 is extended to abut against the front inner vertical plane 66, its bottom 54 will just touch the extension 31 of a retaining plate spring 3. At this moment, the umbrella is still not open, because the retaining claw 32 of the retaining plate spring 3 does not disengage from the lower notch cylinder 4, as shown in FIG. 3.

Subsequently, the button 5 is merely pushed down since the front lateral surface 55 of the button 5 has already been extended against and stopped by the front inner lateral vertical plane 66 of the seat 6. This action will push the plate spring 3 inwardly to produce a clockwise movement about the point 33. The retaining claw 32 is thus disengaged from its coupling with the lower notch cylinder 4 and simultaneously, the lower notch cylinder 4, under the action of the frame structure (not shown), moves toward the tail or tip of the umbrella, hereby automatically opening the umbrella into the status as shown in FIG. 4.

Once force is removed from the push button 5, the V-spring 8 acts to bias the retaining plate spring 3 clockwise tending to force it to return to its original position. The radial extension 31 pushes the bottom 54 of the push button 5 upward, thus making the outer lateral plane 512 of the first arm 51 of the button 5 and the inner lateral plane 522 of the second arm 52 of the push button 5 no longer stopped and caught by the vertical planes 64 and 69 of the seat 6 as shown in FIG. 3. In addition by means of the restoration of the elasticity of the tension spring 7, the push button plane 512 is caught by and engages with the vertical plane 61 of the seat 6, thus automatically restoring the safe locking position as shown in FIG. 2.

As described in the above, when the umbrella is packed up, if the push button 5 is perpendicularly pushed down by an external force without any force being applied to push it even slightly forward, the lock will not be released, this is because even with the push button 5 depressed, the bottom planes 511 and 521 of the arms 51 and 52 remain caught by and engaged with horizontal planes 62 and 67 of seat 6. The button 5 will not contact the extension 31 of the retaining plate spring 3, since there is still a clearance remaining between the bottom 54 of the push button 5 and the extension 31. Therefore, when it is actually desired to open the umbrella, a positive force must be applied in both the forward as well as the downward directions. Since necessary efforts to produce such a force is not very strong, normal finger force is good enough. The degree of force is necessary only to compress the tension spring 7 and it does not need to be powerful. Thus, the present invention advantageously overcomes the common carelessness of the user or other person's action leading too often to an improper and untimely opening of the umbrella. Unless the user intentionally or acknowledgeably opens the umbrella, the inadvertent events of the user's or other's carelessness or unexpected contact with the button to push it forward and downward will be reduced to the minimum, if not completely.

Furthermore, no matter whether the umbrella is packed up or open, whenever the applied force is removed from the button 5, under the actions of both the tension spring 7 and the extension 31 of the retaining plate spring 3, the button 5 will automatically restore itself to its original fire position, thus automatically restoring its safe locking status, completely and without any additional operation applied. In other words, this is done smoothly in one stroke.

FIG. 5A is the drawing of the push button mentioned above. Slot 53 (not shown on this drawing) beneath the second arm 52 of the button body 5 is provided for fitting one end of the tension spring 7.

FIG. 5B is another embodiment of the push button, two flat portions 51', 52' are respectively integrally formed at both ends of the button 5, and a slot 53' is excavated on one side of the bottom part of the button 5' to receive one end of the spring 7. Two pairs of extensions, 511', 512'; and 521' (visible in this drawing), 522' are used instead of two arms 51 and 52 in FIG. 5A as safety stopper. To use this kind of push button, some modification should be made on button seat. All guide planes, 61, 62, 63, 64, 66, 67, 68 and 69 should be made in a direction parallel to the paper instead of perpendicular to the paper as shown in FIGS. 2, 3 and 4.

Two embodiments of guide planes of the button seat 6 are shown in FIGS. 6A and 6B.

The first embodiment of the button seat 6 is to provide a plain surface 62A and a vertical plane surface 64A as a guide for the arm 51 of the push button 5 as shown in FIG. 6A. A plain surface 62, an inclined surface 63 and a vertical plane surface 64 are formed in sequence on the button seat 6 as shown in FIG. 6B as a guide of the arm 51 of the push button 5.

Referring now to FIG. 7, another arrangement of the locking device without any clearance existing between the bottom surface 54 of the button 5 and the extension 91 of the plate spring 9. The reason this clearance can be omitted is that the fulcrum of the plate spring 9 is displaced from original position 33 (as shown in FIGS. 2 to 4) to another place as shown in this figure, whereby the lever distance of the claw portion 92 of the plate spring 9 is smaller than that of the extension 91.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed:

1. A locking device for an automatic opening umbrella comprising:

a seat housed within a handle of the umbrella, said seat having a recess communicating with an opening formed in said handle for receiving a button, and having a plurality of guide planes able to guide said button;

a button having an arm extending from each side thereof formed to fit with said guide planes;

an elastic spring interposed between the button and the seat;

a plate spring having an extension and a claw, said claw being coupled with a lower notch cylinder of the umbrella; and said button and said plate spring being arranged to define under normal conditions a clearance between the bottom of said button and the top of said extension of said plate spring;

whereby on application of a force in the forward and downward direction against the longitudinal axis of the umbrella, said arms of the button will be moved along said guide planes of said seat and thereafter depress the extension of said plate spring to produce a pivotal rotation therein so as to disengage the retaining claw from said lower notch cylinder.

2. The device as defined in claim 1 in which said guide planes of the seat consist of two horizontal planes and two vertical planes.

3. A device as defined in claim 1 in which said guide planes of the seat comprise two horizontal planes, two oblique planes and two vertical planes.

4. A device as defined in claim 1 in which said guide planes include two plain and two oblique planes.

5. A device as defined in claim 1 in which said two arms of the button are formed in L-like configuration.

6. A device as defined in claim 1 in which said two arms of the button are formed in plate-like configuration.

7. The device as defined in claim 1 in which there is no clearance provided between the bottom of the button and the top of the extension of the plate spring and the plate spring is arranged so that the moving distance of said extension is larger than moving distance of said claw of the plate spring.

8. The device as defined in claim 1 push button is returned automatically to its normal lock position once the force is removed from the push button by the plate spring via its recovering action together with the restoration force of said extension spring.

* * * * *